US009695787B2

(12) United States Patent
Newman et al.

(10) Patent No.: US 9,695,787 B2
(45) Date of Patent: Jul. 4, 2017

(54) SEALING SOLUTION FOR REDUCED DIAMETER INTAKE MANIFOLD POST

(71) Applicant: Ford Global Technologies, LLC, Dearborn, MI (US)

(72) Inventors: Chris William Newman, Farmington Hills, MI (US); Katherine Jane Randall, Dearborn, MI (US); David Born, Commerce Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/903,030

(22) Filed: May 28, 2013

(65) Prior Publication Data

US 2014/0352641 A1 Dec. 4, 2014

(51) Int. Cl.
*F02M 35/10* (2006.01)
*F02F 11/00* (2006.01)
*F02M 35/104* (2006.01)

(52) U.S. Cl.
CPC ..... *F02M 35/10144* (2013.01); *F02F 11/00* (2013.01); *F02M 35/104* (2013.01); *F02M 35/10354* (2013.01)

(58) Field of Classification Search
CPC ..... F02M 35/10144; F02M 35/10354; F02M 35/104; F02F 11/00
USPC ..... 123/184.21, 184.61, 184.34, 184.47, 123/184.53
See application file for complete search history.

(56) References Cited

U.S. PATENT DOCUMENTS 2,650,559 A * 9/1953 Waller ..... G01L 19/10 116/270
4,759,672 A * 7/1988 Nilsen ..... A47G 3/00 411/375
4,824,024 A * 4/1989 Bishop ..... B05B 1/3006 239/171
5,165,384 A 11/1992 Knutson
5,400,750 A 3/1995 Jaeger et al.
5,839,404 A 11/1998 Numata et al.
6,378,480 B2 4/2002 Narayanaswamy et al.
(Continued)

OTHER PUBLICATIONS

Publication; Self-Sealing Fasteners, Washers & Threadlockers, Westco Aircraft; www.interfast.ca/apm-hexseal-ad/52-self-sealing fasteners.

*Primary Examiner* — Carlos A Rivera
*Assistant Examiner* — Syed O Hasan
(74) *Attorney, Agent, or Firm* — LeClairRyan

(57) ABSTRACT

A sealing arrangement for a post for an intake manifold having a first portion and a second portion held together is set forth. Each of the portions extends from a shell half that, when the two shells are attached to one another, form the intake manifold. Each of the portions includes a face. A groove is formed on at least one of the portions. A seal is fitted in the groove. A fastener hole is formed in the portions. In one portion, the fastener hole passes through the portion and in the other a thread is formed by a thread forming fastener. The seal may be positioned in a groove formed on a post face, in a groove formed adjacent the opening of the fastener-receiving hole in the post, or in a groove formed on an interior wall of the post adjacent a cap fitted over the head of the thread forming fastener.

16 Claims, 3 Drawing Sheets

(56) References Cited

U.S. PATENT DOCUMENTS

| | | | | |
|---|---|---|---|---|
| 6,622,682 | B2 * | 9/2003 | Ikuma | F02M 35/10039 123/184.34 |
| 6,725,822 | B2 * | 4/2004 | Matsumoto | F02B 27/02 123/184.34 |
| 2010/0088811 | A1 * | 4/2010 | Coronado | E03D 11/14 4/252.4 |
| 2011/0100315 | A1 | 5/2011 | Vichinsky | |
| 2011/0100767 | A1 * | 5/2011 | Wan | F16D 65/097 188/72.1 |
| 2011/0253080 | A1 * | 10/2011 | Newman | F02M 35/10321 123/54.4 |
| 2012/0017864 | A1 | 1/2012 | Moetakef et al. | |
| 2012/0103295 | A1 | 5/2012 | Owen | |

* cited by examiner

SEALING SOLUTION FOR REDUCED DIAMETER INTAKE MANIFOLD POST

TECHNICAL FIELD

The disclosed inventive concept relates generally to intake manifolds for internal combustion engines. More particularly, the disclosed inventive concept relates to a sealing arrangement for a post for an intake manifold.

BACKGROUND OF THE INVENTION

It is common for the modern intake manifold for an internal combustion engine to be formed from a variety of materials, including both metal and polymeric material. Both internal and external bracing (formed on the surface of the manifold) is often desired to provide a reduction of noise radiating from the manifold's surface (reduced NVH) and to provide strength and thereby allow for increased pressure while preventing manifold failure under a backfire condition. Without such posts, the manifold would only comprise a large, unsupported panel which would have the propensity to resonate and to cause undesired noise. Unsupported manifolds also are prone to damage under the above-mentioned backfire condition.

The internal bracing is typically provided in the form of posts formed from either the same material or a different material from the manifold's parent material. In high performance engine applications, the size of the post in the intake manifold can have a negative impact on engine performance. The size of these posts is normally dictated by the weld bead width and the interface between the upper and lower shells as well as by draft requirements on the post and post stability for welding.

The size of the posts often presents a challenge to airflow efficiency. If a larger post is used the result may be that the cross-sectional area of the post reduces the flow area within the intake manifold to an unacceptable degree. This reduction in flow area may result in limiting the peak power of the engine. This issue is particularly important for the naturally aspirated engine, including engines without pressure charging on the intake of the type provided by superchargers or turbochargers.

Experience has shown that the size of the intake manifold may be increased to compensate for the reduction in flow area due to the posts. However, a larger manifold increases both product cost and weight while also complicating packaging. The larger manifold may also demand either an increase in the number of the posts or an increase in the diameter of the posts, with either outcome potentially compromising the purpose of providing the posts in the first place.

In an effort to reduce the diameter of the posts the size of the weld bead was reduced. While post diameter was reduced burst strength was also reduced. Thus a reduction of the size of the weld bead was found not to be an answer to the problem.

As a further development in intake manifold posts thread forming screws without weld beads have been employed that provided a reduction of post diameter from 30 mm to 14 mm (more than 50%). However, in this construction the screw does not offer any sealing function and presents a potential leak path to atmosphere. In response a dust cap has been used in the past to cover the head of the screw with RTV sealant applied between the screw head and the interior of the cap. However, while providing sealing to a certain extent this approach failed to provide an ideal solution in a production environment.

Thus known solutions are either impractical for production applications or are less than ideal insofar as they result in little if any reduction in the size of the post or provide inadequate burst strength. Accordingly, a post for use within an intake manifold that demonstrates good air flow, reduced NVH and adequate burst strength remains wanting.

SUMMARY OF THE INVENTION

The disclosed inventive concept overcomes the problems associated with known post designs. Particularly, a sealing arrangement for a post for an intake manifold having a first portion and a second portion held together by a thread forming fastener is set forth. Each of the portions extends from a shell half that, when the two shells are attached to one another, form the intake manifold. Each of the portions includes a face and, when the two portions are connected to one another, the faces oppose one another.

A groove is formed on at least one of the portions. A seal is fitted in the groove. A fastener hole is formed in the portions. In one portion the fastener hole passes through the portion. In the other portion a thread is formed in at least part of the hole upon insertion of a thread forming bolt or similar fastener used to connect the two portions and to thereby secure one shell to the other shell. (As a possible alternative a threaded insert may be provided in the portion to which the threaded fastener is threaded for attachment.)

Three embodiments of the post sealing solution of the disclosed inventive concept are set forth. The sealing solutions may be used alone or in combination with each other to enhance the integrity of the seal.

In one embodiment of the disclosed invention the seal-receiving groove is formed in one or both faces of the post portions. A seal is provided in the groove. When the two portions are fastened together a seal is formed between the faces.

In another embodiment of the disclosed invention the groove is formed adjacent to the opening of the post portion through which the thread forming fastener passes. A seal is provided in the groove. When the two portions are fastened together a seal is formed between the head of the thread forming fastener and the hole for the mechanical fastener of the post portion through which it passes.

In a third embodiment of the disclosed invention the post portion having the fastener-passing hole formed therethrough has an interior defined by a fastener-supporting wall that substantially surrounds the fastener-passing hole and a post wall. The groove for the seal is formed in the post wall. A channel is partially formed between the fastener-supporting wall and said inner post wall. A u-shaped cap is fitted over the head of the thread forming fastener. The wall of the cap partially fits within the channel between the fastener-supporting wall and the inner post wall. A seal is formed between the inner post wall and the wall of the u-shaped cap.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

As those of ordinary skill in the art will understand, various features of the embodiments illustrated and described with reference to any one of the figures may be combined with features illustrated in one or more other figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations.

Figure 1:
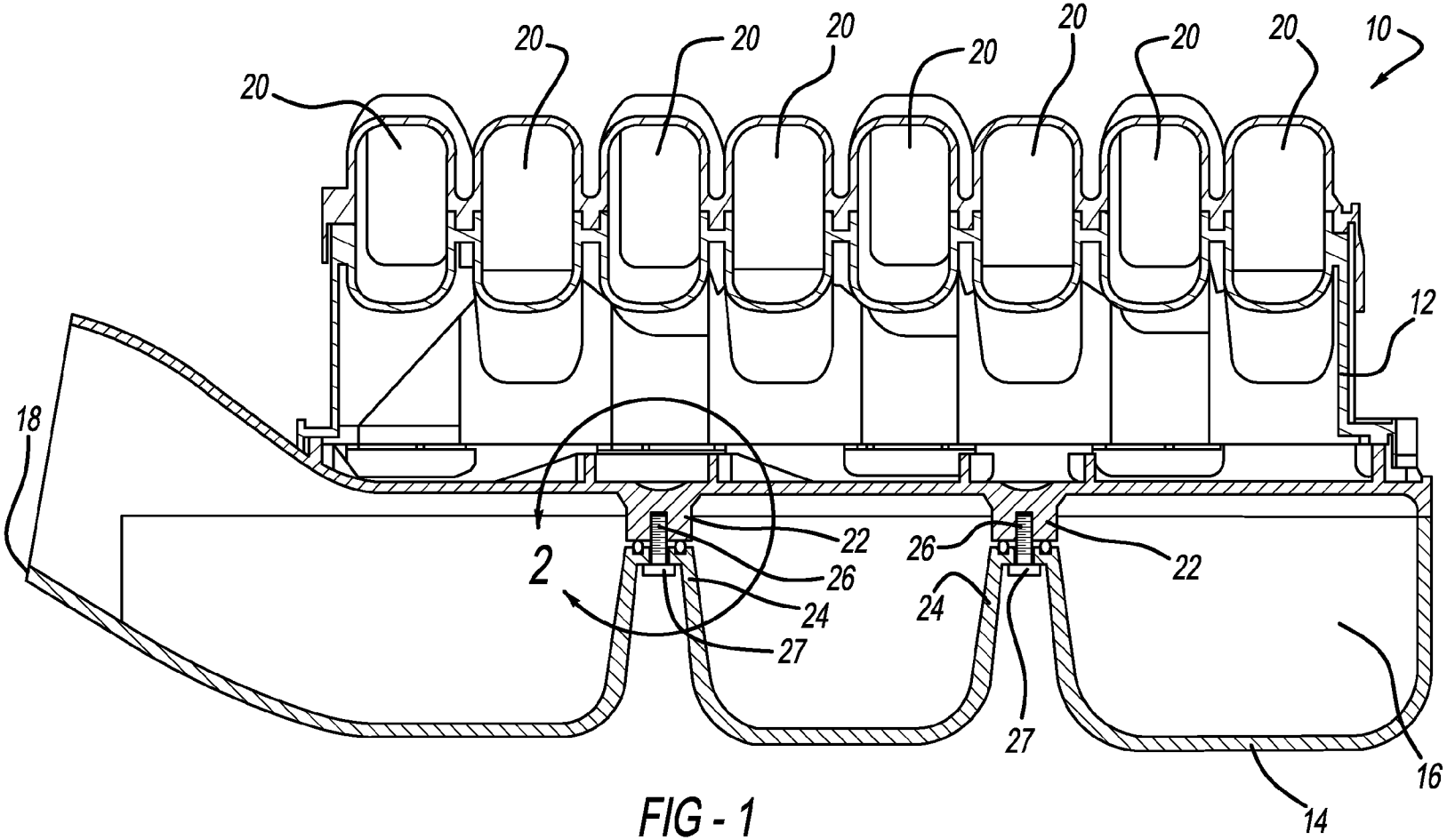
FIG. 1 is a cross-sectional view of an intake manifold according to the disclosed inventive concept.

FIG. 1 illustrates a cross-sectional view of an intake manifold according to the disclosed inventive concept, generally illustrated as 10. The intake manifold 10 includes an upper shell portion 12 and a lower shell portion 14. It is to be understood that reference to "upper" and "lower" when describing the shell portions 12 and 14 is only made for the sake of convenience and is not intended as being limiting. Specifically, while conventionally intake manifolds in today's vehicles are generally positioned horizontally above the engine it is conceivable that the intake manifold according to the disclosed inventive concept may alternatively be vertically positioned to the side of the engine.

A cavity 16 is formed between the upper shell portion 12 and the lower shell portion 14. The intake manifold 10 also includes a throttle body mounting flange 18. A plurality of intake runners 20 is formed as part of the upper shell portion 12. It is to be understood that the overall configuration of the intake manifold as set forth in FIG. 1 is suggestive and is not intended as being limiting as other configurations may be possible without deviating from the spirit and scope of the disclosed inventive concept.

The upper shell portion 12 has two upper posts 22 extending downwardly. The lower the portion 14 has two lower posts 24 extending upwardly. The upper shell portion 12 and the lower shell portion 14 are coupled together by mechanical fasteners such as thread forming bolts 26. Each of the thread forming bolts 26 includes a bolt head 27. The number and placement of the posts 22 and 24 and the thread forming bolts 26 are shown in FIG. 1 for illustrative purposes and are not intended as being limiting.

The disclosed inventive concept benefits from the use of a seal between the upper post and the lower post. Three embodiments of the disclosed inventive concept are set forth herein.

Figure 2:
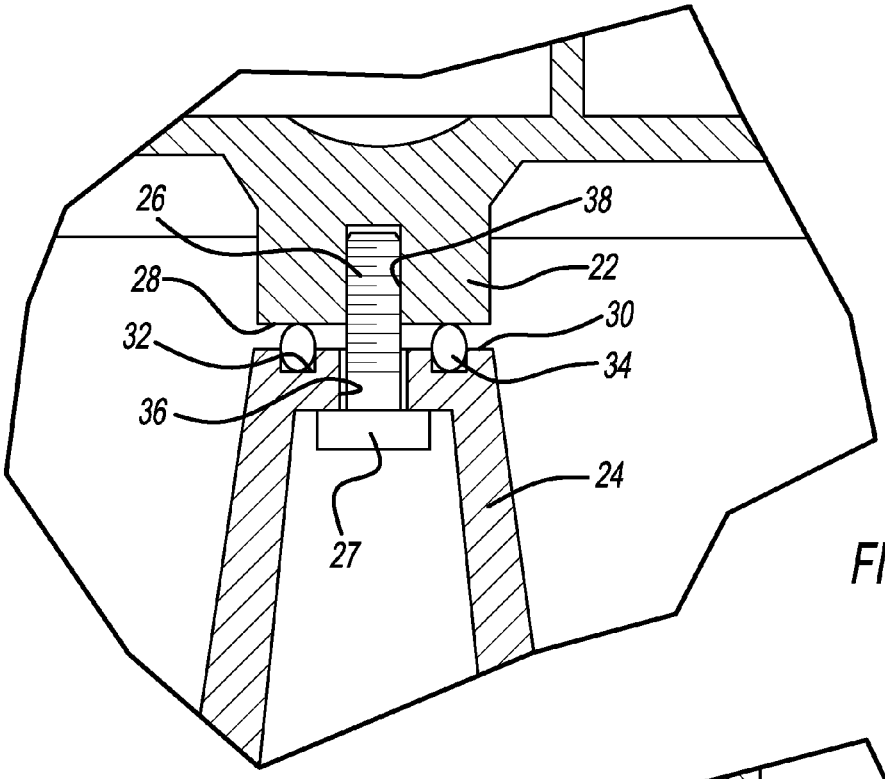
FIG. 2 illustrates a close-up of the post construction shown in FIG. 1 according to a first embodiment of the disclosed inventive concept.

With respect to FIG. 2, a close-up of the post construction shown in FIG. 1 according to the first embodiment of the disclosed inventive concept is illustrated. This embodiment is directed generally to forming a seal between the upper post 22 and the lower post 24. This embodiment could be combined with laser or sonic welded manifold shells to avoid scrubbing of the gasket during shell welding. In addition, in those instances where a nominal gap remains after shell welding this embodiment might be used to close the gap during bolt rundown.

The upper post 22 includes an upper post face 28. The lower post 24 includes a lower post face 30. Defined in the lower post face 30 is a seal groove 32. A seal 34 formed from a polymeric material suited for high heat, high pressure applications such as polytetrafluoroethylene (PTFE) is positioned within the groove 32. Other materials may be suited for this purpose as well. While the groove 32 is shown as being formed in the lower post face 30 it may be alternatively or additional formed in the upper post face 28. According to the first embodiment of the disclosed inventive concept a fluid-tight seal is thus formed by the seal 34 between the upper post face 28 and the lower post face 30.

A smooth bore hole 36 is formed in the lower post 24 through which the thread forming bolt 26 freely passes. A hole 38 is formed in the upper post 22 into which the threaded end of the thread forming bolt 26 is threaded upon assembly, thereby securely mating the upper shell portion 12 with the lower shell portion 14 upon assembly. Alternatively the smooth bore hole 36 may be formed in the upper post 22 and the hole 38 may be formed in the lower post 24.

Figure 3:
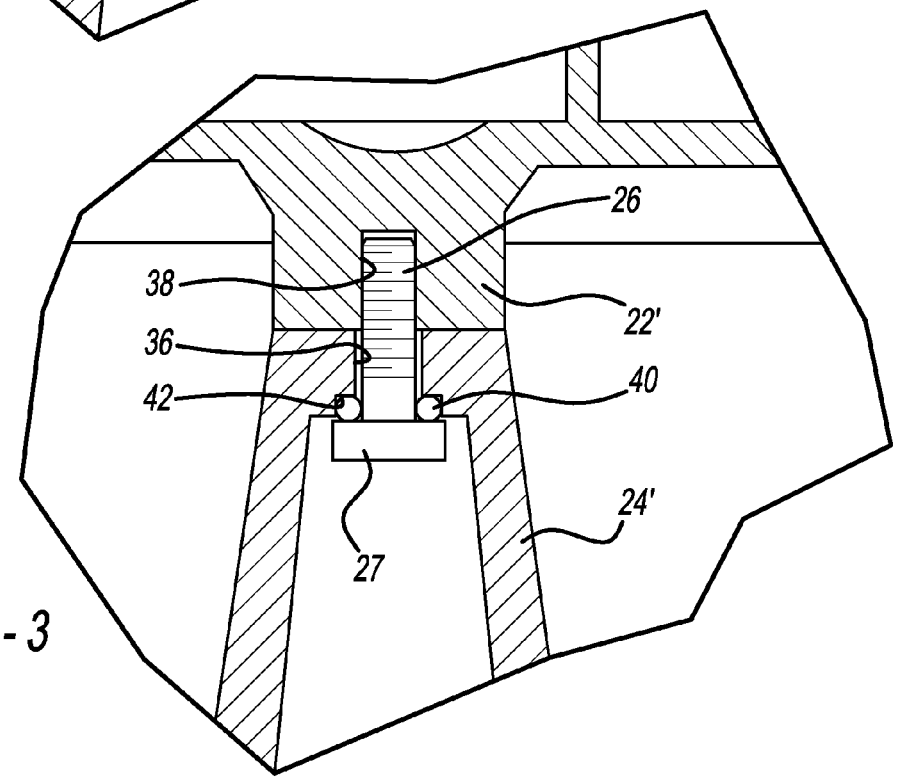
FIG. 3 illustrates a second embodiment of the disclosed inventive concept.

With respect to FIG. 3, a close-up of a post construction according to the second embodiment of the disclosed inventive concept is illustrated. This embodiment is generally directed to providing a seal under the bolt head 27. According to this embodiment, an upper post 22' and a lower post 24' are provided. Instead of the seal being provided between the post faces as shown in FIG. 2 and as discussed in relation thereto, a seal 40 it is instead provided adjacent the bolt head 27 of the thread forming bolt 26. More particularly, a groove 42 is formed around the open end of the smooth bore hole 36 of the lower post 24'. The seal 40 is fitted into the groove 42. According to the second embodiment of the disclosed inventive concept a fluid-tight seal is thus formed by the seal 40 between the thread forming bolt 26 and the lower post 24'.

Figure 4:
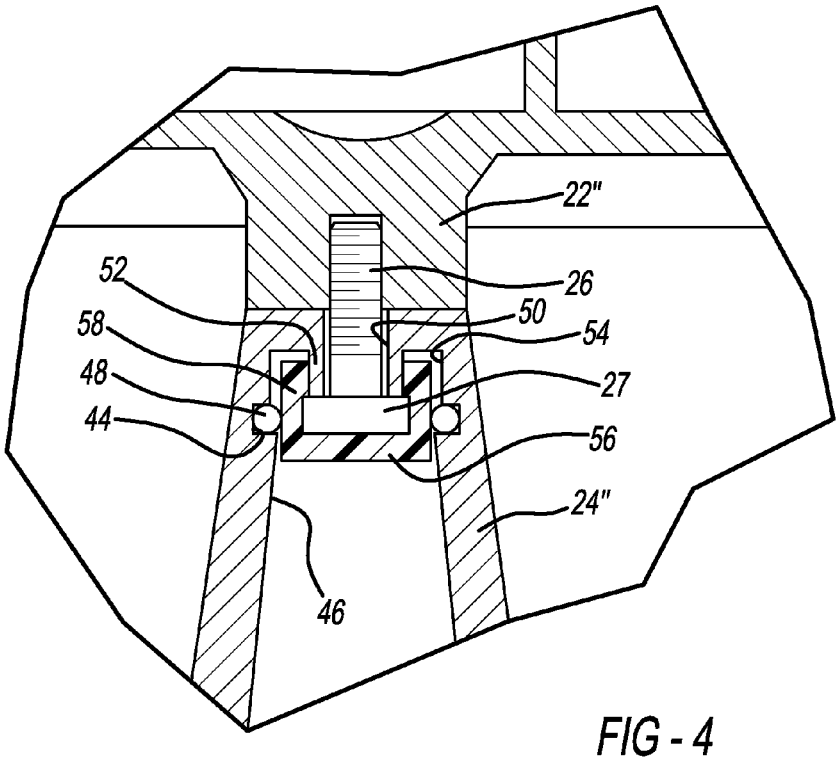
FIG. 4 illustrates a third embodiment of the disclosed inventive concept.

With respect to FIG. 4, a close-up of a post construction according to the third embodiment of the disclosed inventive concept is illustrated. According to this embodiment, an upper post 22" and a lower post 24" are provided. Instead of the seal being provided between the post faces as shown in FIG. 2 and as discussed in relation thereto or adjacent the bolt head 27 as shown in FIG. 3 and as discussed in relation thereto, a groove 44 is formed in an interior wall 46 of the lower post 24". A seal 48 is fitted into the groove 44.

A fastener passing hole 50 is formed through a portion of the lower post 24" thus defining a hole supporting wall 52. A channel 54 is defined between the hole supporting wall 52 and the interior wall 46.

A u-shaped, clip-on cap 56 is fitted over the bolt head 27. The u-shaped cap 56 may be formed from any suitable material such as a plastic and may be used on any bolt requiring sealing. The u-shaped cap 56 includes a cap wall or skirt 58 which substantially fits into the channel 54 between the interior wall 46 and the interior wall 46. According to the third embodiment of the disclosed inventive concept a fluid-tight seal is thus formed by the seal 48 between the interior wall 46 and the u-shaped cap 56.

While the groove 44 is shown in FIG. 4 as being formed in the interior wall 46 it is to be understood that the groove 44 might alternatively be formed in the cap wall or skirt 58 of the u-shaped, clip-on cap 56.

Use of any one of the three above-described embodiments of the disclosed inventive concept is not restricted to solitary usage. For example, the arrangement shown in FIG. 2 could be used with either or both of the arrangements shown in FIGS. 3 and 4.

The disclosed invention as set forth above overcomes the challenges faced by known sealing solutions. However, one skilled in the art will readily recognize from such discussion, and from the accompanying drawings and claims that various changes, modifications and variations can be made therein without departing from the true spirit and fair scope of the invention as defined by the following claims.

What is claimed is:

1. An intake manifold for an internal combustion engine comprising: a first shell; a second shell; a first post portion extending from said first shell and including a first fastener-passing hole, wherein the first fastener passing hole has a first diameter; a second post portion extending from said second shell and including a second fastener-thread-receiving hole, wherein the second fastener passing hole has a second diameter and having a groove formed therein; a fastener positioned through the first fastener-passing hole and threadedly coupled in the second fastener-thread-receiving hole; a cap fitted over at least a portion of said fastener, said cap having a skirt; a seal fitted in said groove, said cap being in direct contact with said fastener and said seal, and wherein the fastener is a thread-forming fastener.

2. The intake manifold for an internal combustion engine of claim 1, wherein said first post includes a face and said second post includes a face, said faces being opposed to one another.

3. The intake manifold for an internal combustion engine of claim 1, wherein the thread forming fastener includes a third diameter, and wherein the second diameter is less than the third diameter, such that the thread forming fastener forms internal threads in the fastener-thread-receiving hole when the thread forming fastener is threadedly coupled in the fastener-thread-receiving hole.

4. The intake manifold for an internal combustion engine of claim 2, wherein said groove is substantially circular, is positioned in the face of the first post, and substantially circumscribes the fastener-passing hole.

5. The intake manifold for an internal combustion engine of claim 1, wherein the fastener-passing hole includes a fastener-head end oriented towards a head of the fastener, wherein the fastener-passing hole includes an opening at the fastener-head end, wherein the groove substantially circumscribes the opening, and wherein the seal is positioned between the head of the fastener and the first post.

6. A post arrangement for an intake manifold having a first shell and a second shell, said arrangement comprising: a first post portion extending from the first shell and including a first bore having a first diameter; a second post portion extending from the second shell and including a second bore having a second diameter; a fastener passing through said portions, said fastener having a first end and a second end; a groove formed in one of said posts, the groove having a generally circular shape and substantially circumscribing at least one of the first bore and the second bore; a seal fitted in said groove; a cap fitted over part of said first end said fastener, said cap having a skirt, said cap being in direct contact with said first end of said fastener and said seal, and wherein the fastener is a thread-forming fastener.

7. The post arrangement for an intake manifold of claim 6 wherein said first post portion includes a face and said second post portion includes a face, said faces being opposed to one another and wherein said groove is formed in one of said faces.

8. The post arrangement for an intake manifold of claim 6 wherein the thread forming fastener passing through the first bores, which includes a diameter larger than a thread forming diameter of the thread forming fastener, and the thread forming fastener tapping the second bores, having a second bore diameter less than the thread forming fastener.

9. The post arrangement for an intake manifold of claim 8 wherein the first bore includes a fastener-head end oriented toward a head of the thread forming fastener, wherein the first bore includes an opening at the fastener-head end, wherein the groove substantially circumscribes the opening, and wherein the seal is positioned between the head of the thread forming fastener and the first post.

10. The post arrangement for an intake manifold of claim 8 wherein one of said post portions includes an interior surface and wherein said groove is formed on said interior surface whereby a seal is formed between said cap and said interior surface when said cap is fitted to said fastener head.

11. The post arrangement for an intake manifold of claim 10 wherein said cap defines a U shape in cross section.

12. A sealing arrangement an intake manifold comprising: a first shell of the intake manifold having a first post, which includes a fastener passing hole; a second shell of the intake manifold having a second post, which includes a fastener-attachment hole, said post including an interior surface having a base wall; a circular groove substantially circumscribing the fastener-passing hole or the untapped hole, said groove being spaced apart from said base wail; a seal fitted in said groove; a fastener for coupling the first shell to the second shell by passing through the fastener-passing hole and into said fastener-attachment hole, said fastener including a head; a cap having a skirt, said skirt being positioned between said seal and said head, said cap being in direct contact with said head and said seal, and wherein the fastener is a thread-forming fastener.

13. The sealing arrangement of claim 12 further including a face formed on the first post and a face formed on the second post, said faces being opposed to one another and wherein said groove is formed in one of said faces.

14. The sealing arrangement of claim 12, wherein the fastener the fastener-passing hole includes a fastener-head end oriented toward a head of the thread forming fastener, wherein the fastener-passing hole includes an opening at the fastener-head end, wherein the groove substantially circumscribes the opening, and wherein the seal is positioned between the head of the thread forming fastener and the first post.

15. The sealing arrangement of claim 12 wherein the fastener includes a fastener head and wherein a fastener head cap is fitted over said fastener head.

16. The sealing arrangement of claim 15 wherein the first post includes an interior surface spaced apart from said fastener-passing hole and wherein said groove is formed on said interior surface whereby a seal is formed between said cap and said interior surface when said cap is fitted to said fastener head.

* * * * *